US007703864B2

(12) United States Patent
Moser

(10) Patent No.: US 7,703,864 B2
(45) Date of Patent: Apr. 27, 2010

(54) FOLDED AND GLUED DISPLAY CONTAINER HAVING INTEGRAL SHELF ELEMENTS ERECTED BY DISPLACEMENT OF SUPPORT PANEL

(75) Inventor: James Moser, Levittown, PA (US)

(73) Assignee: McLean Packaging Corporation, Philadelphia, PA (US)

( * ) Notice: Subject to any disclaimer, the term of this patent is extended or adjusted under 35 U.S.C. 154(b) by 559 days.

(21) Appl. No.: 11/623,395

(22) Filed: Jan. 16, 2007

(65) Prior Publication Data

US 2008/0169339 A1 Jul. 17, 2008

(51) Int. Cl.
*A47B 43/02* (2006.01)
*A47B 47/06* (2006.01)
*A47F 5/11* (2006.01)

(52) U.S. Cl. ..... 312/261; 206/747; 206/749; 206/750; 211/135; 211/149; 229/120.14; 229/120.15; 312/259

(58) Field of Classification Search ..... 229/120.14, 229/120.15, 120.19, 120.21, 120.24, 120.25, 229/120.28, 120.31, 120.37, 148, 152, 153; 312/258, 259, 261, 315, 316; 206/746–750, 206/761; 211/135, 149; 108/179; 248/174
See application file for complete search history.

(56) References Cited

U.S. PATENT DOCUMENTS 2,150,743 A * 3/1939 Mancuso ..... 211/135
2,435,135 A * 1/1948 Franck ..... 229/161
2,759,652 A * 8/1956 Burgess ..... 229/120.14
2,884,179 A * 4/1959 Rossum ..... 229/120.14
3,514,031 A * 5/1970 Burgess ..... 229/120.14
3,765,044 A * 10/1973 Hanahan et al. ..... 15/104.8
4,927,073 A * 5/1990 Esposito ..... 229/117.07
5,315,936 A * 5/1994 Smith ..... 108/165
6,527,167 B1 3/2003 Sheffer

* cited by examiner

*Primary Examiner*—Gary E Elkins
(74) *Attorney, Agent, or Firm*—Blank Rome LLP

(57) ABSTRACT

A rectilinear folded and glued container with tiered shelves has multiple shelf panels cut out of a front panel with which the shelf panels, and main container front, side and back panels are integrally connected. The container has an internally placed shelf-raising panel that is attached to the shelf panels as part of a fold and glue processing technique that produces a knocked down flat container to be erected. The shelf raising panel preferably is an integral panel that is separate from the main container panels so as to be relatively movable, and is affixed to the shelf panels. Displacing or translating the shelf-raising panel during erection of the container from its knocked-down-flat configuration articulates the shelves into position. The shelf raising panel can be captured between top and bottom ends of the erected container, thus fixing the erected container and articulated shelves in a rigid shape.

20 Claims, 7 Drawing Sheets

FOLDED AND GLUED DISPLAY CONTAINER HAVING INTEGRAL SHELF ELEMENTS ERECTED BY DISPLACEMENT OF SUPPORT PANEL

FIELD OF THE INVENTION

The invention relates to paperboard, corrugated craft and similar containers made in a fold and glue line and typically supplied in a collapsed or knocked-down-flat configuration that can be readily erected. According to one aspect, at least one relatively movable panel is incorporated and is coupled by fold and glue connections with integral parts of a die cut blank. Movement of the panel causes parts of the container, especially tiered shelves, to move into operative position during erection of the container.

BACKGROUND OF THE INVENTION

Corrugated and paperboard containers are made from pieces of flat stock that are typically die cut into shapes that define various panels. The shapes are folded along strategic lines between the panels, and at least one overlapping strip or panel is typically glued, taped or otherwise affixed to another panel to form a closed perimeter. The various panels are intended to become the walls, top and/or bottom of a full or partial enclosure when folded into place. Often, the containers are supplied in a collapsed or flattened parallelogram state (known as knocked-down-flat or "KDF"), for efficient storage, handling and shipping. Before packing, the containers are opened out into a hollow form and the panels are folded to reside in orthogonal planes.

Such containers can be more or less complicated. A simple version known as the regular slotted carton (RSC) has four side walls, each of which has a top and bottom flap. More complicated versions have doubled-over panels, reinforcing folded parts, inter-engaging tabs and slots and other features.

Such containers advantageously are produced by feeding flat integral die cut sheets through a fold-and-glue machine, such as those available from Bobst Group, Inc. of Roseland, N.J., to apply adhesive and preliminarily to fold over select panels so that the panels are adhered in a KDF state for shipping or storage, ready to be erected into their final configuration by articulating the panels around adjoining folds. A simple RSC version is erected by pressing inwardly from diagonally opposite corners and folding the flaps inwardly by 90° from their adjoined panels. In relatively more complicated full or partial containers, various panels may need to be folded in appropriate directions in appropriate order. Various tabs may need to be inserted into respective slots and so forth.

Containers as described can be used for displaying items or goods for the consumers at the point-of-sale location. Minimizing the effort and complication required to erect and set up the containers is an important factor for the viability and success of the particular container design. Thus, the number of parts required to erect or assemble the containers from their KDF configuration is an important element in the acceptability of the container design.

Generally, a container design is most efficient if most or all of its panels, tabs and other parts are integral panels and extensions of panels cut from a single flat blank, i.e., integral parts of the same sheet of material. Separate discrete parts such as separate lids, inserted partitions, shelves, reinforcing inserts and the like require attention to inventory, manual assembly steps and other complications during the production, erection and set up of the container. Separate parts are not desirable.

For these reasons, conventional KDF-type containers routinely are provided in a single piece flat blanks wherein all the panels necessary to construct or erect a container are members of a single sheet of stock material, cut out along an outline and scored or perforated at fold lines so as to provide all the necessary parts in an integral unit. The various seams are glued and the various folding connections between panels are cut, scored, compressed, etc.

The die cut integral blanks, preferably preliminarily weakened along prospective fold lines, are processed through the fold and glue machine. Glue is applied at preselected surfaces that are to overlap at seams. Panels are folded around fold joints. The KDF container blanks are thus produced and assembled in a state ready to be packed and shipped. For more complicated container designs, for example including lids or inserts, the KDF container blanks may be accompanied by separate discrete parts, but they add cost and require time for inventory attention, assembly and other reasons.

Because conventional KDF containers preferably are integral sheets, the panel layout design and general container complexity are limited. There is a need for ways to permit container designs to be made into complex structures, but without entailing complex parts and extensive assembly steps.

SUMMARY OF THE INVENTION

A folded and glued container according to one embodiment comprises four major panels defined by a back panel, laterally opposite sidewalls joined to the back panel, and a front panel opposite the back panel and joined to the sidewalls. The four major panels define an internal space of the container. Shelf panels, generally more than one, are cut out of the front panel for forming shelves. Each of the shelf panels are joined to the front panel along one side in same orientation. A shelf-raising panel that is movable relative to the sidewalls, front panel and/or back panel is provided in the space defined internally within the container. The shelf-raising panel is attached to the shelf panels in an articulated manner, and in other respects is displaceable or translatable within the container. When the four major panels are erected from a knocked-down-flat configuration into a rectilinear box, a relative displacement or translation of the shelf-raising panel causes the shelf panels to articulate in unison into their erected configuration. The shelf raising panel preferably is an integral part that is separate from an integral die cut blank having panels that form the front, back, sidewalls and shelves. However in the fold and glue assembly line process of affixing the respective panels in a knocked down flat (KDF) configuration, the necessary attachments between the shelf raising panel and the shelves are made, while confining the shelf raising panel inside the front, back and side walls of the KDF container.

BRIEF DESCRIPTION OF THE DRAWINGS

A number of additional objects and aspects are apparent from the appended description and the associated illustrations of preferred embodiments, wherein.

All drawings are schematic and not to scale. Like structures are shown in like reference numbers.

DETAILED DESCRIPTION

Figure 1:
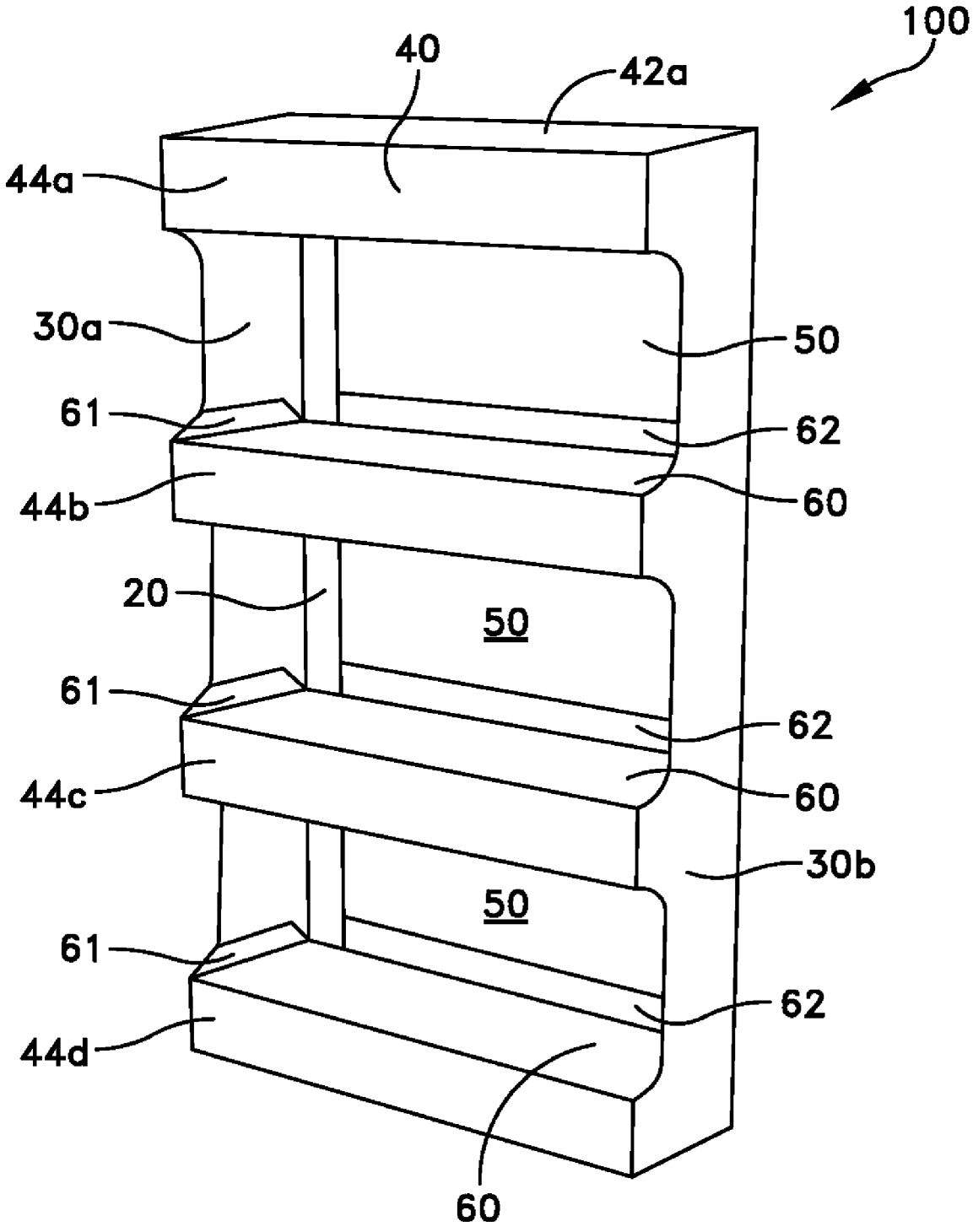
FIG. 1 is a perspective view of an erected container according to one embodiment of the present invention.

As will be appreciated, terms such as "horizontal," "vertical," "left," "right," "up," "down," "top," "bottom," "front" and "back," (etc.), used as nouns, adjectives or adverbs (e.g. "horizontally, "rightward," "upwardly," "downwardly," etc.) refer in this description to the orientation of the structure of the invention as it is illustrated in the particular drawing figure when that figure faces the reader. Such terms are not intended to limit the invention to a particular orientation. Similarly, the terms "longitudinal" and "lateral" generally refer to the orientation of surfaces or other structures relative to an axis of elongation or axis of rotation, as appropriate. The terms "integral", "integrally connected" or "integrally joined" when used to describe the relationship between two or more structures means that the structures are comprised of a single piece of material.

The terms "connected" and "interconnected", when used to describe the relationship between two or more structures, mean that such structures are secured or attached either directly or indirectly through intervening structures and include movable connections such as pivoting connections. The term "operatively" means that the foregoing direct or indirect connections between such structures allow the structures to operate as described and intended by virtue of such connection.

Lines representing fold lines are shown in the drawings by broken and solid lines that represent lines along which the material can be weakened or caused preferentially to fold by any of various means. For example, corrugated or other material can be compressed along a thin line defining a fold, or can be cut part way through along the line, or cut all or part way through the line at spaced intervals. Each of these and similar techniques form lines along which the material is folded or made readily foldable, in the knocked-down flat ("KDF") blank and/or in the erected container.

Portions of joints in which glued surfaces are exposed to view in the drawings and discussed in this description are sometimes shown in the relevant figures by "XXX" patterns, representing an area to which adhesive has been or will be applied. Areas where the glue on a rear face of a respective panel is relevant are at times shown in broken line "XXX" patterns, indicating an adhering surface on a side opposite from the side shown (i.e., the backside).

Referring to FIG. 1, a folded and glued container 100 according to an embodiment in erected configuration is shown. The container 100 is a rectilinear box container comprised of four major panels defined by a back panel 20, laterally opposite sidewalls 30*a*, 30*b* joined to the back panel, and a front panel 40 opposite the back panel 20 and integrally joined to the sidewalls. The front panel 40 comprises a plurality of front face panels 44*a*, 44*b*, 44*c*, and 44*d*. The front face panels 44*a*-44*d* are portions of a front panel 40 from a die-cut blank 10*a*, shown in FIG. 2, that remain after at least one shelf panels 60 is die-cut from the integral sheet of the front panel 40. These major panels substantially define the internal space of the container, and although knocked down flat when initially produced, open out when the container is erected.

Shelf panels 60 (advantageously more than one shelf panel is provided) are cut out of the front panel and form shelves. In this illustrated example, a tier of three shelf panels 60 is shown. Thus, each of the shelf panels 60 is integrally joined to the front face panels 44*a*-44*d* along a fold line 5*f*. A shelf-raising panel 50 is provided as a supplemental piece carried movably within the internal space of the container 100. The shelf raising panel 50 is attached to the shelf panels 60 via the tab portions 62 of each of the shelf panels 60. In this application, "supplemental piece" refers to a panel that is not integrally connected with any of the major panels and instead is provided as at least one separately integral piece. The shelf raising panel 50 can be cut from the same larger blank as the other parts of the container but is a separate panel rather than one integral with the major panels, so as to be relatively movable. One embodiment with separate rather than integrally connected panel 50 and major die-cut blank are shown in FIG. 2.

Other than being attached to the shelf panels 60 the shelf-raising panel 50 is a supplemental piece that is displaceable within the container 100 such that when the major panels are erected from the KDF configuration into a rectilinear box, a displacement of the shelf-raising panel 50 raises the shelf panels 60 in unison into the erect configuration due to connections between the shelves and the shelf-raising panel that are made during the fold and glue preliminary assembly process preceding erection.

The front face panels 44*a*-44*d* of the shelves extend downwardly perpendicular to the surface of their associated shelves as shown in FIG. 1. By turning the container 100 over (or by configuring the parts in an upside down orientation from the orientation shown in FIG. 1), the front face panels 44*a*-44*d* in between each shelf panels can function as a front bumper edge for each of the shelves and prevent items displayed on the shelves from sliding off. Whether the front edge protrudes downwardly or upwardly, the front edge stiffens the shelves against bowing under a load placed on the shelves.

Figure 2:
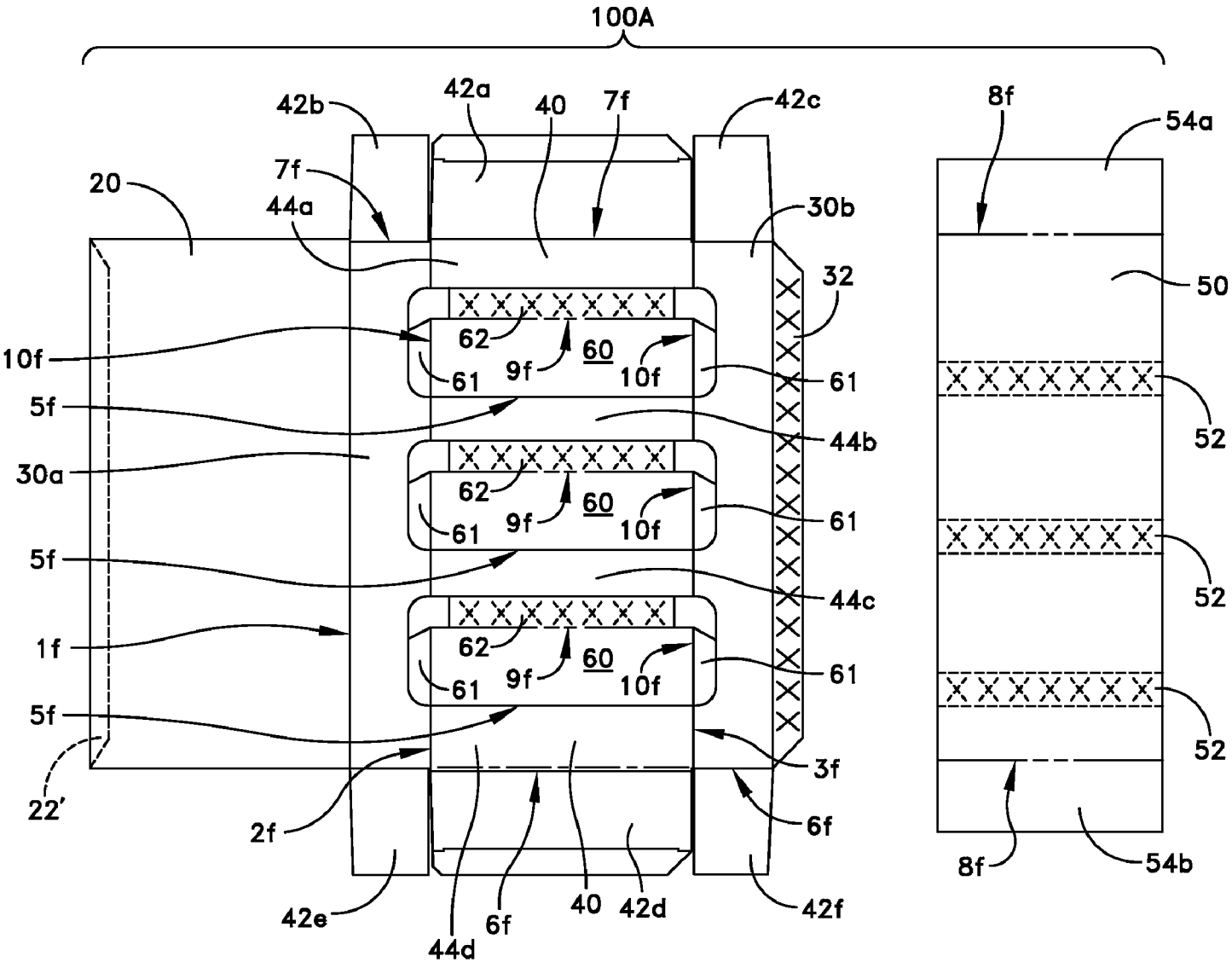
FIG. 2 is a plan view of the die-cut blank for the container of FIG. 1.

FIG. 2 is a plan view of a die-cut blank 100*a* for the container 100 cut from a single flat blank sheet of stock material. The die-cut blank 100*a* can be cut, for example, from a sheet of corrugated board, paperboard or other suitable sheet material. A number of thicknesses can be die cut in a single step. Advantageously, the die-cut blank 100*a* can be cut out individually so that the blank can be scored or compressed or perforated along predetermined fold lines, at the same time that the perimeter of the blank is cut from the sheet.

The die-cut blank 100*a* is preliminarily assembled by passing the blank 100*a* together with a shelf-raising panel 50 through a fold and glue machine processing line. As these parts advance along the processing line, adhesive is applied to respective parts that need to adhere. Panels, flaps or strips that need to be folded over are urged by rollers to pass along deflectors that turn the necessary parts around crease lines. The end result is an assembled but knocked down flat KDF container blank 100*b*, shown in FIG. 3.

The various panels of the container 100 described above can be seen in the die-cut blank 100*a*. The die-cut blank 100*a* comprises the back panel 20 that is integrally joined to a first sidewall 30*a* along a fold line 1*f*. The first sidewall 30*a* is joined to the front panel 40 along a fold line 2*f*. The front panel 40 is joined to a second sidewall 30*b* along a fold line 3*f*. A tab 32 is joined to the second sidewall 30*b* along a fold line 4*f*. When the die-cut blank 100*a* is folded and glued into the KDF container blank 100*b*, the tab 32 is glued, folded along the fold line 4*f* and attached to the region 22 of the back panel 20, thus, joining the back panel 20 to the second sidewall 32*b*. The attachment of the tab 32 to the region 22 is generally achieved by an adhesive but alternatively, fasteners of appropriate type may be used, such as, for example, staples, clips, rivets, etc. Preferably, the major panels, the back panel 20, the sidewalls 30*a*, 30*b*, and the front panel 40 are die cut from a single sheet of stock material and are, thus, integrally joined.

Generally, plural shelf panels 60 are cut out of portions of the front panel 40 so that the shelf panels 60 are integrally joined to the front panel 40 on one side of the shelf panels along fold lines 5*f*. In other words, the side of the shelf panels 60 opposite from the fold lines 5*f* where the tabs 62 are provided is not joined to the front panel 40. As discussed in conjunction with the erected container 100, once the shelf panels 60 are cut, the remaining portions of the front panel 40 form the front face panels 44*a*-44*d*.

The die-cut blank 100*a* is an example having three shelf panels 60 cut into the front panel 40. Each of the shelf panels 60 has one or more tabs 62 for attaching to the shelf-raising panel 50. In the illustrated example, the tabs 62 are configured as a single tab for each of the shelf panels 60. However, the tabs 62 can be configured as more than one tabs per shelf panel 60. The fold lines 5*f* are appropriately scored or creased to preferentially fold in the desired direction allowing the shelf panels 60 to swing inwards into the interior space of the container 100 when being erected. When formed into a KDF container blank 100*b* shown in FIG. 3, the tabs 62 are attached to the glued areas 52 of the shelf-raising panel 50. The shelf panels 60 may also be configured to include optional side tabs 61. These optional side tabs 61 fold upward along fold lines 10*f* when the container 100 is erected and can form side retaining walls for the shelves 60 as shown in FIG. 1.

The die-cut blank 100*a* may also be configured with additional panels and/or tabs for providing structures for closing the top and bottom of the container 100. For example, as shown in FIG. 2, the die-cut blank 100*a* includes a set of top closure panels 42*a*, 42*b*, 42*c* and a set of bottom closure panels 42*d*, 42*e*, 42*f* that are longitudinally opposite from the top closure panels. Each group of three closure panels 42*a*, 42*b*, 42*c* and 42*d*, 42*e*, 42*f* are integrally joined to the front panel 40 and the sidewalls 30*a*, 30*b* along the fold lines 6*f* and 7*f*, respectively. Each group of three closure panels constitute a typical three-panel container closure configuration found in many consumer product packaging.

There are numerous possibilities for arranging adjacent panels of an integral die-cut blank sheet. Some panels can be joined to adjacent panels at creases. Some panels can be joined at perforation lines that can be torn. Some panels can be separated from adjacent panels by die cut slots. Portions of the sheet can be removed to leave gaps.

Figure 3:
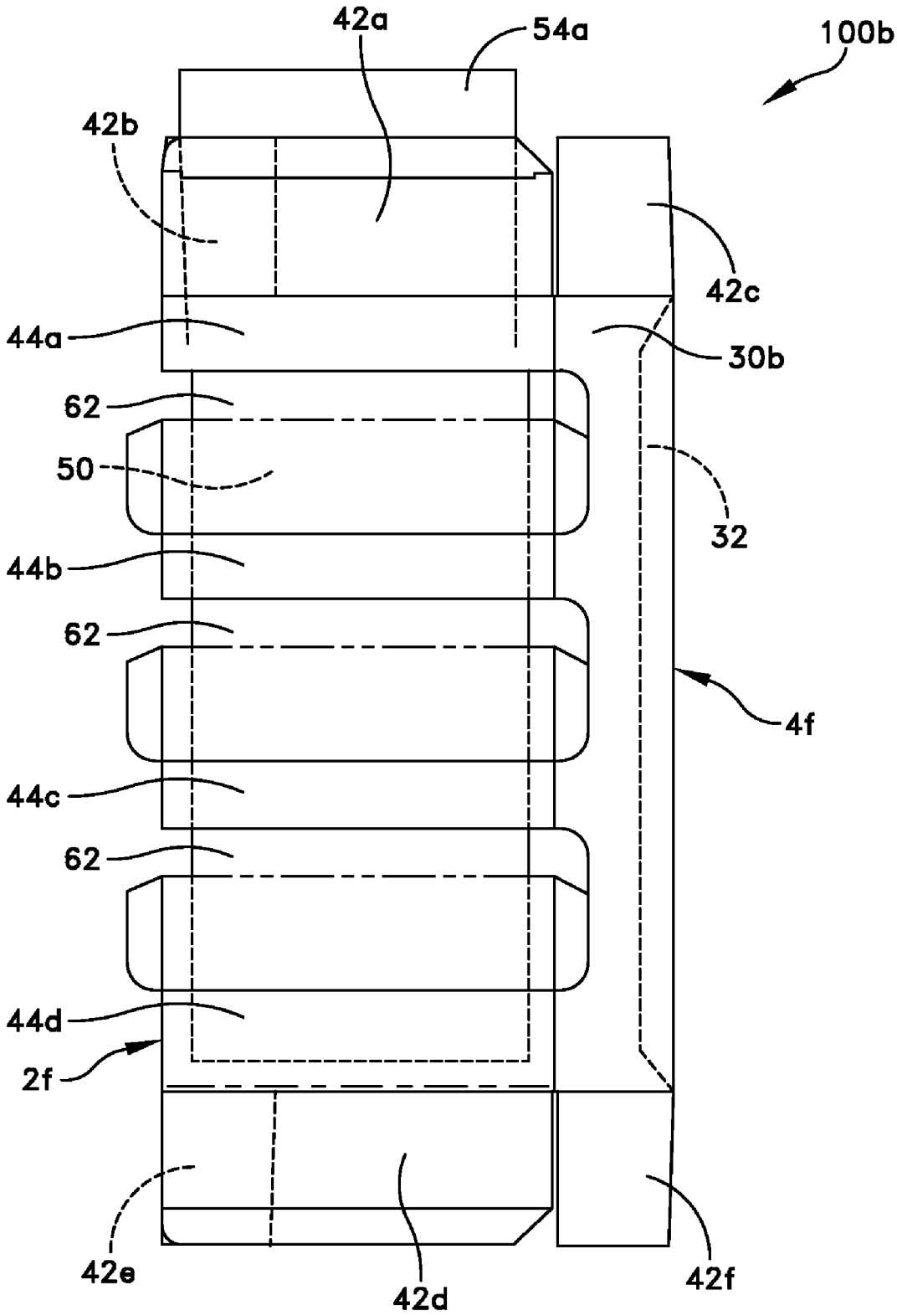
FIG. 3 is a plan view of the KDF container blank for the container of FIG. 1 that has been folded and glued from the die-cut blank of FIG. 2.

FIG. 3 shows the KDF container blank 100*b* constructed by folding and gluing the die-cut blank 100*a* and the shelf-raising panel 50, preferable by using a fold and glue machine. The fold-and-glue process may be carried out by fold-and-glue machines, such as those available from Bobst Group, Inc. of Roseland, N.J. Fold-and-glue machines apply adhesive to pre-selected areas of the die-cut blank and preliminarily fold over pre-selected panels. The shelf-raising panel 50 and the remaining main portion of the die-cut blank 100*a* are fed into the fold-and-glue machine as separate discrete pieces to be formed into a KDF container blank.

In forming the KDF container blank 100*b*, the fold-and-glue machine applies an adhesive to the glue areas 52 of the shelf-raising panel 50 and the tab 32. Then the machine attaches the shelf-raising panel 50 to the main portion of the die-cut blank by aligning the tabs 62 of the shelf panels 60 to the corresponding glue areas 52. Next, the fold-and-glue machine folds the die-cut blank along the fold lines 2*f* and 4*f* in the same direction so that the tab 32 and the region 22 of the back panel 20 align for attachment. In the finished KDF container blank 100*b*, the tab 32 which has been folded behind the side panel 30*b* and attached to the back panel 20 is shown in broken lines. The shelf-raising panel 50 is now attached to the tabs 62 and resides between the front panel 40 and the back panel 20 and is also shown in broken lines. The top portion 54*a* of the shelf-raising panel 50 is shown extending beyond the top closure panel 42*a*. An alternative configuration for the KDF container blank 100*b* can be formed by folding the die-cut blank along the fold lines 1*f* and 3*f*.

In making the KDF container blanks, such as the blank 100*b*, for various embodiments of the invention, the fold-and-glue machine will glue and attach a separate supplemental piece, such as the shelf-raising panel 50, to the remaining main portion of the die-cut blank 100*a*. The fold-and-glue machine then incorporates the supplemental piece with the main portion of the die-cut blank 100*a* to form a KDF container blank 100*b*. The fold-and-glue machine will generally apply adhesive to shelf-attachment or glue areas 52 and attach the shelf-raising panel 50 to the die-cut blank 100*a* so that the shelf-attachment areas 52 are aligned with the tabs 62 of the shelf panels 60. The shelf-raising panel 50 may also be attached to the shelf panel's tabs 62 by use of one or more staples, clips, rivets, or other suitable fasteners.

Referring to FIGS. 4-7, the process of erecting the exemplary container 100 from the KDF container blank 100*b* will be described. To erect the container 100, the KDF container blank 100*b* is pushed in along the sides defined by the folded lines 2*f* and 4*f*. The back panel 20, the two sidewalls 30*a*, 30*b* and the front face panels 44*a*-44*d* will first form an interim structure whose lateral cross-section is a parallelogram and then into a rectangular configuration so that the back panel 20 and the sidewalls 30*a*, 30*b* are at right angles to each other. At this stage, the container is open at both the top and bottom ends.

Figure 4:
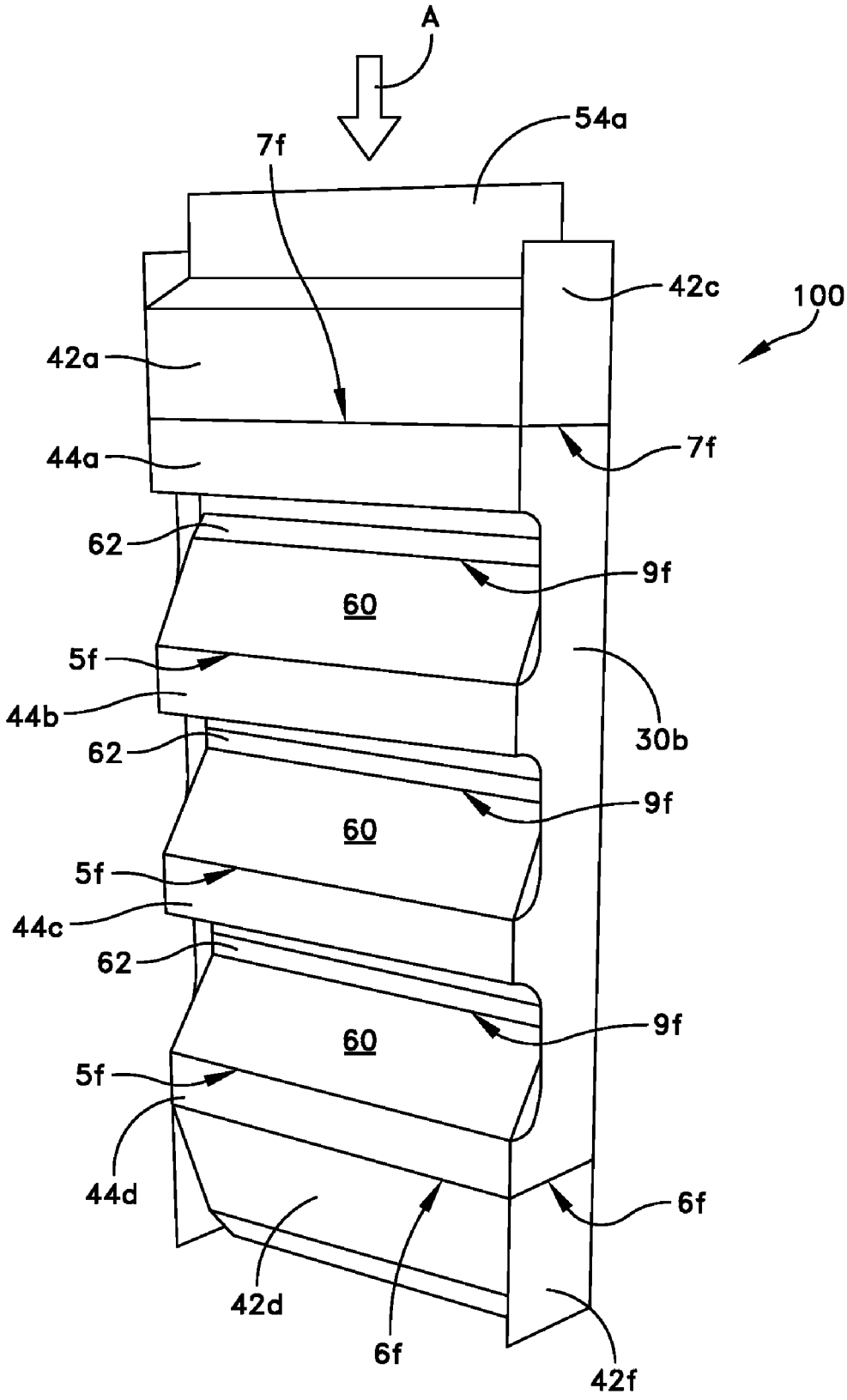
FIG. 4 is a perspective view of an interim stage in the process of erecting the container of FIG. 1.

Next, the shelf-raising panel 50 is then pushed down or displaced in the direction of arrow A, shown in FIG. 4, to erect the shelves. In FIG. 4, the end wall portion 54*a* is shown extending out of the interior space of the container 100. This interim configuration is shown in FIG. 4. Because the shelf-raising panel 50 is attached to the tabs 62 of the shelf panels 60, when the shelf-raising panel 50 is displaced in this manner, the shelf panels 60 will preferentially fold along the fold lines 5*f* and 9*f* and swing inwards forming the interim configuration illustrated in FIG. 4.

Figure 5C:
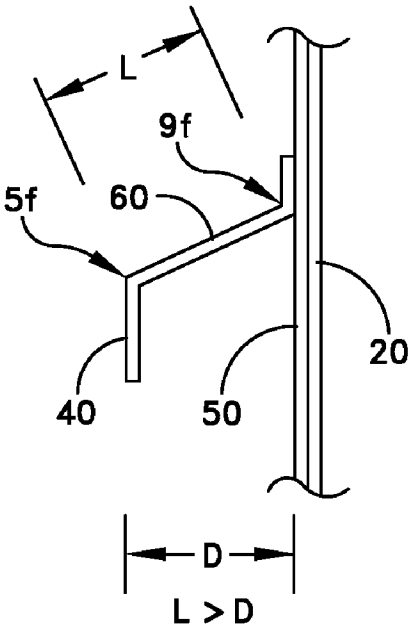
FIG. 5*c* is another embodiment of the fully erected configuration of FIG. 5*b;*
Figure 5B:
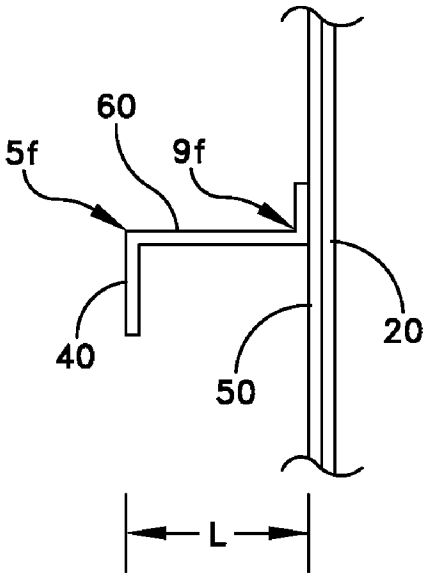
FIG. 5*b* is the cross-sectional view of FIG. 5*a* after the container has been fully erected.
Figure 5A:
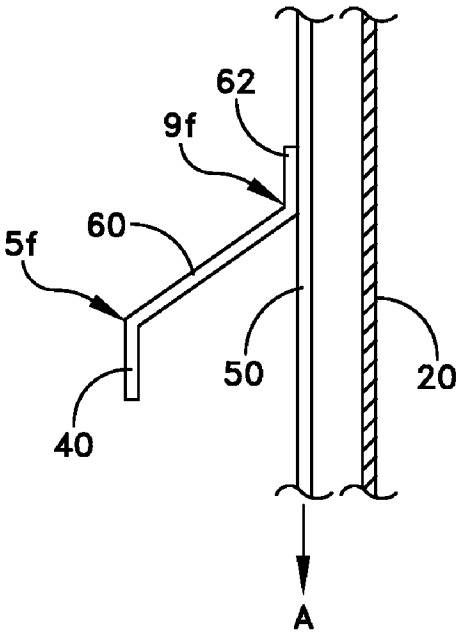
FIG. 5*a* is a partial longitudinal cross-sectional view of the container shown in FIG. 4.

This motion is better illustrated in FIG. 5*a* which is a longitudinal cross-sectional view of the configuration of FIG. 4 illustrating one of the shelf panels 60. As can be seen, because the shelf-panels 60 are joined to the front panel 40 along the fold line 5*f*, which in effect is a living hinge, at one side of the shelf-panel 60 and attached to the shelf-raising panel 50 at the opposite side by the tab 62, which is joined to the shelf panel 60 along the fold line 9*f*. The fold lines 5*f* and 9*f* are appropriately crimped or pinched so that when the shelf-raising panel 50 is displaced in the direction of the arrow A, the shelf panel 60 will preferentially fold along the fold lines 5*f* and 9*f* as shown and the shelf panel 60 will swing down into the internal space of the container 100.

The shelf-raising panel 50 is displaced until the shelf-raising panel 50 is pressed against the back panel 20 by the shelf panel 60 as shown in FIG. 5*b* which marks the fully erected configuration of the container 100. In this example, when the container is fully erected, the shelf panels 60 will be perpendicular to the back panel 20. But by varying the length L (marked in FIG. 5*b*) of the shelf panels 60, defined as the distance between the fold lines 5*f* and 9*f*, the shelves can be set to a desired angle. For example, if the length L of the shelf panels 60 were longer than the distance D (see FIG. 5*c*) between the front panel 40 and the back panel 20, the shelf-raising panel 50 will be pressed up against the back panel 20 and affix the shelf panels' position before the shelf panels reach perpendicular orientation of FIG. 5*b* and will be at an incline. This alternative configuration is illustrated in FIG. 5*c*. Consequently, in the example of FIG. 5*b*, the length L would be equal to the distance D between the front panel 40 and the back panel 20 minus the thickness of the shelf-raising panel 50.

Figure 6:
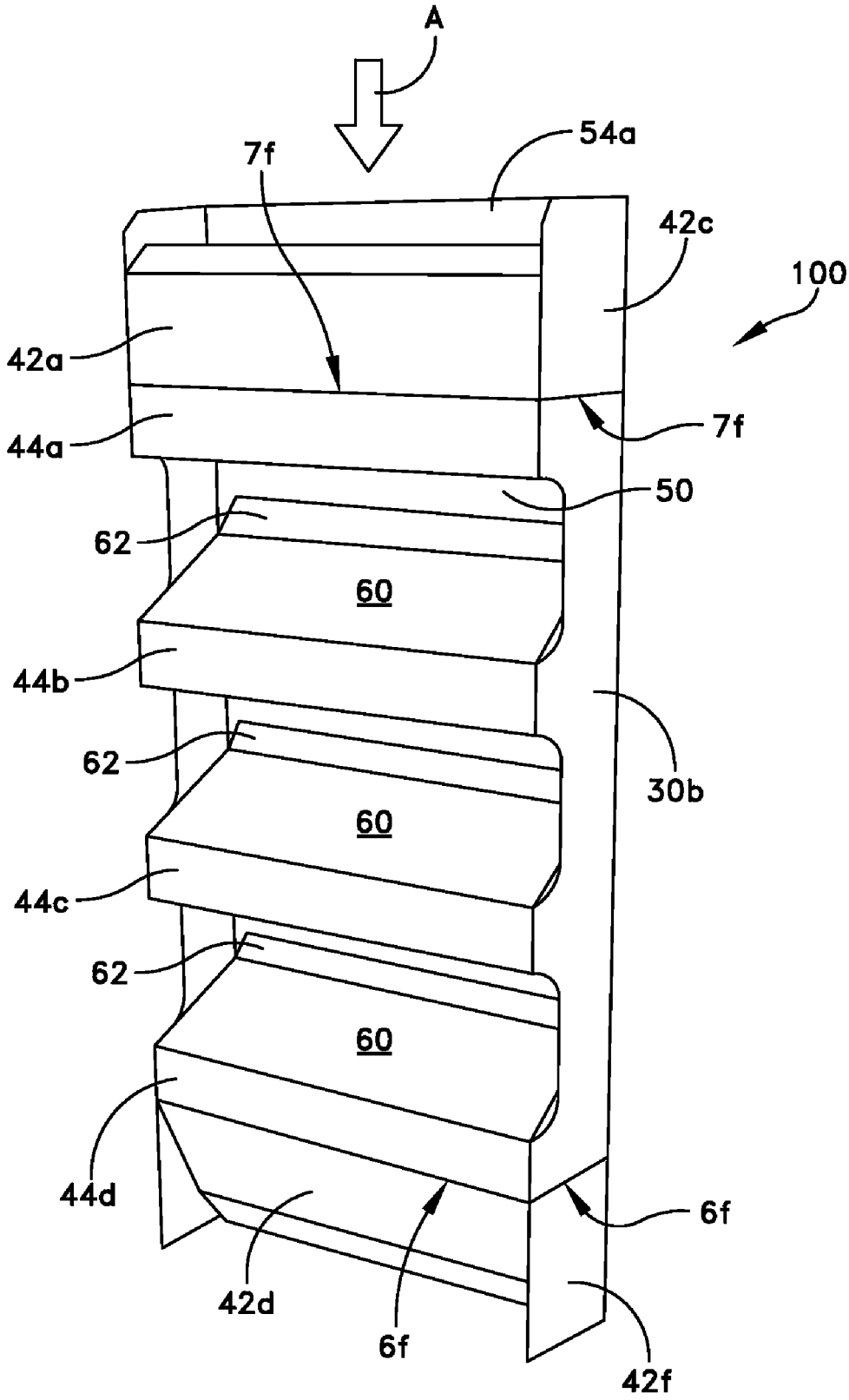
FIG. 6 is a perspective view of the container of FIG. 4 at a later stage in the process of erecting the container.

FIG. 6 illustrates another interim configuration of the container 100 where the shelf-raising panel 50 has been displaced further in the direction A. As shown, the shelf panels 60 are folded or swung down further into the interior space of the container 100.

Figure 7:
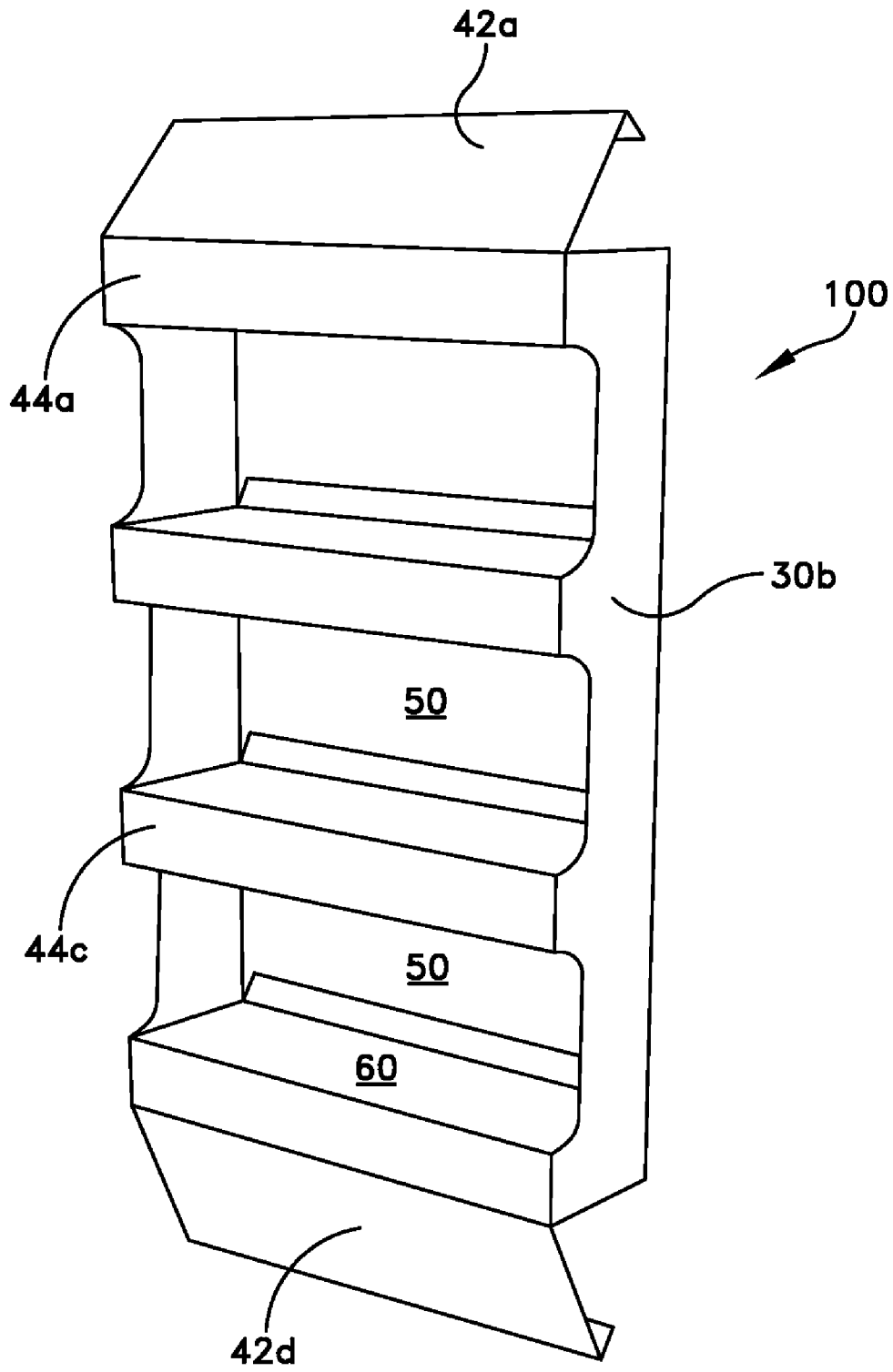
FIG. 7 is a perspective view of the container of FIG. 6 at a later stage in the process of erecting the container.

In FIG. 7, the shelf-panel 50 has been fully displaced until the shelf panels 60 are in their final position. The end wall portions 54*a* and 54*b* of the shelf-raising panel 50 have been folded along fold lines 8*f* into the interior space of the container. The top closure panels 42*b*, 42*c* and the bottom closure panels 42*e*, 42*f* have been folded in along their respective fold lines 7*f* and 8*f* and the closure panels 42*a* and 42*d* are shown before closure. Once the closure panels 42*a* and 42*d* are closed, the fully erected container 100 is as illustrated in FIG. 1

The shelf-raising panel 50 is preferably configured to be longer than the front and back panels 40, 20 so that when the shelf panels 60 are in their final affixed position, there are extra end wall portions 54*a*, 54*b* foldable along fold lines 8*f* that extend beyond the lengths of the front and back panels 40, 20. To close the closure panels 42*a*, 42*b*, 42*c* and 42*d*, 42*e*, 42*f* of the container 10, the end wall portions 54*a*, 54*b* are folded in along the fold lines 8*f*.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. A folded and glued container comprising:

four major panels defined by a back panel, laterally opposite sidewalls joined to the back panel, and a front panel opposite the back panel and joined to the sidewalls, the four major panels defining an internal space of the container;

two or more shelf panels cut out from the front panel for forming shelves, each of the shelf panels being joined to the front panel along one side; and a shelf-raising panel formed from a piece of material separate from the remaining portions of the container and provided within the internal space of the container, the shelf-raising panel being attached to the two or more shelf panels and being displaceable within the internal space of the container, wherein displacement of the shelf-raising panel erects the two or more shelf panels in unison with one another when the container is erected from a knocked-down-flat configuration into a rectilinear box shape.

2. The container of claim 1, wherein the four major panels are cut from a single sheet of stock material and integrally joined.

3. The container of claim 1, wherein the two or more shelf panels are integrally joined to the front panel.

4. The container of claim 1, wherein the shelf-raising panel is attached to the two or more shelf panels by an adhesive.

5. The container of claim 1, wherein the shelf-raising panel is attached to the two or more shelf panels by one or more fasteners.

6. The container of claim 1, further comprising longitudinally opposite top and bottom closure panels formed separately from the shelf-raising panel so the top and bottom closure panels are erected separately from the two or more shelf panels.

7. The container of claim 1, wherein each of the shelf panels comprise one or more tabs for attaching to the shelf-raising panels and have a length defined as the distance between a first fold line joining the shelf panel to the front panel and a second fold line joining the one or more tabs to the shelf panel, the length being substantially equal to the distance between the front panel and the back panel.

8. The container of claim 1, wherein each of the shelf panels comprise one or more tabs for attaching to the shelf-raising panels and have a length defined as the distance between a first fold line joining the shelf panel to the front panel and a second fold line joining the one or more tabs to the shelf panel, the length being greater than the distance between the front panel and the back panel.

9. The container of claim 6, wherein the shelf-raising panel includes at least one end wall portion that extends beyond at least one of the top and bottom closure panels when the container is in the knocked-down-flat configuration.

10. The container of claim 1, further comprising side tabs on the two or more shelf panels that form side retaining walls for the two or more shelves.

11. A method for making a folded and glued container comprising the steps of:

forming a back panel, laterally opposite sidewalls joined to the back panel, and a front panel opposite the back panel and joined to the sidewalls, the back panel, sidewalls, and front panel defining an internal space of the container;

forming two or more shelf panels in the front panel for erecting into shelves, each of the shelf panels being joined to the front panel along one side thereof;

forming a shelf-raising panel from a piece of material separate from the remaining portions of the container;

displaceably installing the shelf-raising panel in the internal space of the container; and attaching to the two or more shelf panels to the shelf-raising panel, wherein the container is configured such that displacement of the shelf-raising panel erects the two or more shelf panels in unison with one another when the container is erected from a knocked-down-flat configuration into a rectilinear box shape.

12. The method of claim 11, wherein the step of forming the back panel, sidewalls, and front panel includes cutting the back panel, sidewalls, and front panel from a single sheet of stock material such that the back panel, sidewalls, and front panel are integrally joined to one another.

13. The method of claim 11, wherein the step of forming the two or more shelf panels includes forming the two or more shelf panels such that the two or more shelf panels are each integrally joined to the front panel.

14. The method of claim 11, wherein the step of attaching the shelf-raising panels to the two or more shelf panels includes attaching the two or more shelf panels with an adhesive.

15. The method of claim 11, wherein the step of attaching the shelf-raising panels to the two or more shelf panels includes attaching the two or more shelf panels with one or more fasteners.

16. The method of claim 11, further comprising the step of forming longitudinally opposite top and bottom closure panels separately from the shelf-raising panel so the top and bottom closure panels are erected separately from the two or more shelf panels.

17. The method of claim 16, wherein the step of forming the shelf-raising panel includes forming the shelf-raising panel with at least one end wall portion that extends beyond at least one of the top and bottom closure panels when the container is in the knocked-down-flat configuration.

18. The method of claim 11, wherein each of the shelf panels is formed with one or more tabs for attaching to the shelf-raising panels and have a length defined as the distance between a first fold line joining the shelf panel to the front panel and a second fold line joining the one or more tabs to the shelf panel, the length being substantially equal to the distance between the front panel and the back panel.

19. The method of claim 11, wherein each of the shelf panels is formed with one or more tabs for attaching to the shelf-raising panels and have a length defined as the distance between a first fold line joining the shelf panel to the front panel and a second fold line joining the one or more tabs to the shelf panel, the length being greater than the distance between the front panel and the back panel.

20. The method of claim 11, wherein the step of forming the two or more shelf panels includes forming side tabs on the two or more shelf panels that provide side retaining walls on the two or more shelves.

* * * * *